United States Patent [19]

Taylor

[11] Patent Number: 4,896,823

[45] Date of Patent: Jan. 30, 1990

[54] MAILER WITH RETURN ENVELOPE

[75] Inventor: James C. Taylor, Columbia, S.C.

[73] Assignee: Moore Business Forms, Inc., Grand Island, N.Y.

[21] Appl. No.: 230,032

[22] Filed: Aug. 9, 1988

[51] Int. Cl.[4] ..... B65D 27/06

[52] U.S. Cl. ..... 229/73; 229/92.3; 229/69

[58] Field of Search ..... 493/216, 231, 264, 267, 493/919, 923; 229/73, 69, 92.3, 92.1

[56] References Cited

U.S. PATENT DOCUMENTS

| | | | |
|---|---|---|---|
| 769,536 | 9/1904 | Dixon | 229/73 |
| 1,434,097 | 10/1922 | Conner . | |
| 2,279,164 | 4/1942 | Gettleman . | |
| 2,355,348 | 8/1944 | Welliver et al. . | |
| 2,669,464 | 2/1954 | Lay et al. | 229/73 |
| 2,673,680 | 3/1954 | Deutschmeister et al. . | |
| 2,910,222 | 10/1959 | Bermingham, Jr. et al. . | |
| 3,152,800 | 10/1964 | Hanson . | |
| 3,184,150 | 5/1965 | Hubbard . | |
| 3,255,952 | 6/1966 | Black . | |
| 3,693,869 | 9/1972 | Eaves, Jr. . | |
| 3,701,468 | 10/1972 | Steinhauser . | |
| 3,726,471 | 4/1973 | Kalb . | |
| 4,063,398 | 12/1977 | Huffman . | |
| 4,524,903 | 6/1985 | Vath | 229/73 |
| 4,668,211 | 5/1987 | Lubotta et al. . | |
| 4,669,652 | 6/1987 | Seguin | 229/73 |
| 4,715,531 | 12/1987 | Stewart et al. . | |
| 4,726,802 | 2/1988 | Volk, Jr. . | |
| 4,756,468 | 7/1988 | Jenkins | 229/73 |

FOREIGN PATENT DOCUMENTS

| | | | |
|---|---|---|---|
| 3511529 | 8/1986 | Fed. Rep. of Germany . | |
| 1415972 | 3/1965 | France . | |
| 2254192 | 7/1975 | France | 229/73 |
| 2334620 | 11/1977 | France . | |
| 2365491 | 4/1978 | France . | |
| 51-30830 | 5/1976 | Japan . | |
| 3058 | of 1912 | United Kingdom | 229/73 |
| 2029371 | 3/1980 | United Kingdom | 229/92.3 |
| 1594798 | 12/1981 | United Kingdom | 229/73 |

OTHER DOCUMENTS

"The PostMatic 830 Series" brochure, Moore Paragon U.K. Limited

*Primary Examiner*—Stephen Marcus
*Assistant Examiner*—Jes F. Pascua
*Attorney, Agent, or Firm*—Nixon & Vanderhye

[57] ABSTRACT

The C-fold mailer includes first, second and third panels foldable about transversely extending foldlines to form a mailer with return envelope. Adhesive is applied to one face of the sheet along opposite side margins. The second and third panels are folded and adhesively secured along three margins and the first panel is adhesively secured along the outside face of the third panel. By arranging the lines of adhesive relative to perforated lines along the sides and one end of the mailer, registering sides and end portions of the mailer may be removed while retaining the return envelope adhesively secured along three sides. An integral flap is provided whereby a portion of the first panel may be used as a remittance slip. The slip may be inserted into the return envelope, and the flap folded to seal the return envelope.

28 Claims, 6 Drawing Sheets

MAILER WITH RETURN ENVELOPE

BACKGROUND OF THE INVENTION

The present invention relates to a continuous business form web which can be separated into discrete forms and folded to form mailers having a return envelope, and particularly relates to a "C" fold mailer with return envelope which is relatively simple to produce and readily and easily knocked down or disassembled such that a portion of the mailer may be reused as a return envelope. The present invention also relates to a method of forming the C-fold mailer with return envelope.

It is, of course, well known to use continuous business form webs which can be separated into discrete forms and folded to form mailers with integral return envelopes. Many of those mailers, however, are difficult to produce on a continuous basis. For example, in certain mailers, glue or adhesive is necessarily applied to both sides of the web, and this renders their production somewhat difficult and more expensive. Additionally, because of the multiple folds used in many mailers, printing is frequently necessary on both sides of the form. All of this increases the cost of producing the mailer.

Further, a number of mailers are confusing and difficult for the addressee to disassemble such that the return envelope is not torn or destroyed and remains intact and useful for its intended purpose. For example, many such mailers have multiple instructions at various locations about the mailer directed to the initial addressee. These instructions detail the sequence of steps necessary for the recipient of the mailer to open the mailer and retrieve its contents, such that at the same time, the return envelope may be retained in useful, intact condition. Still further, it has often been difficult in mailers to use preprinted information such that the slips or invoices included with the mailer may be disposed in the return envelope in a manner enabling the proper address to appear on the return envelope or even to fit within the return envelope. Many such invoices or the like must be folded by the original addressee in order to use the return envelope.

SUMMARY OF THE INVENTION

In accordance with the present invention, there is provided a mailer with return envelope which is simple to produce, has all of the adhesive patterns applied to one side of the form, thereby facilitating its production at minimum cost, and permits most of the information, including variable information which may be computer-generated, to be applied to one side of the form, preferably the same side on which the adhesive is applied. The present invention also provides mailers in continuous sheet form whereby printing, adhesive application, and cutting and slitting operations on a high-speed basis may be accomplished. The cutting and slitting operations, of course, facilitate subsequent separation of the forms into individual mailers. Thus, the sheet form of the present invention is readily manipulated to form the mailer by automated processes.

In a particular embodiment of the present invention, a continuous business form web is provided including a plurality of individual elongated sheets or forms attached one to the other by transversely extending lines of perforations whereby the individual sheets may be detached one from the other to form the mailers. Longitudinally extending lines of perforations are inset along and from the opposite edges of the sheets to define marginal feed strips. A plurality of longitudinally spaced tractor openings are provided along the marginal feed strips, whereby the continuous web may be fed automatically, for example, in a printer. Each sheet comprises first, second and third panels, longitudinally spaced one from the other. First and second foldlines are formed between the first and second panels and the second and third panels, respectively. On one side of the sheet, a heat seal adhesive is applied to the margins of the first panel outside of the longitudinally extending perforation lines and also transversely along the distal end of the first panel outwardly of a first laterally extending perforation line. This first perforation line is spaced longitudinally a predetermined distance from the distal end of the first panel. The first panel also has another transverse perforation line spaced from the first foldline and which defines between it and the first foldline a laterally extending strip on which vegetable-based ink is coated, for purposes which will become clear. These two lateral perforation lines in the first panel define a detachable panel portion or ticket which may, for example, comprise a remittance slip and associated stub or receipt.

This second panel is preferably free of adhesive and has a die-cut window through which recorded information, for example, an address, may be displayed. The second panel also has a second laterally extending perforation line spaced longitudinally a predetermined distance from the second foldline, i.e., the same distance the first perforation line in the first panel is spaced from the distal end of the first panel.

The third panel has a third laterally extending perforation line spaced from the second foldline a distance equal to the distance the transverse perforation line in the second panel is spaced from the second foldline. Additionally, the side margins of the third panel, a well as the laterally extending margin of the third panel adjacent the second foldline are provided with a heat-seal adhesive. More particularly, the side adhesive margins in the third panel straddle the longitudinally extending perforation lines. Similarly, the adhesive applied adjacent the second foldline also straddles the third laterally extending perforation line of the third panel. On the distal end of the third panel, there is provided a flap foldable about a third laterally extending foldline. A rewettable adhesive is applied to the flap.

To fold the sheet to form the mailer, a C-type folding is provided. Particularly, the second and third panels are folded about the second foldline such that the adhesive applied to the third panel registers with the face of the second panel. This locates the flap with its rewettable adhesive in opposition to the laterally extending strip of the first panel coated with the vegetable-based ink whereby adherence of the rewettable adhesive to the first panel is prevented. The first panel, together with the flap, may then be folded over the back side of the third panel such that the adhesive about the margins of the first panel registers with the margins of the third panel. By applying heat, the adhesive is activated to secure the panels together and form the mailer.

By folding the sheet in this manner, the longitudinal extending perforation lines in each panel register each with the other, while the first, second and third laterally extending perforation lines of the first, second and third panels, respectively, register each with the other. Additionally, address information is provided on the face of the third panel which, when folded to form the mailer, appears for display through the die-cut window of the second panel.

When the mailer is received, the recipient tears the opposite side marginal portions along the longitudinally registering perforation lines to remove them. The recipient also tears along the top of the mailer along the first, second and third laterally extending and registering perforation lines. It will be appreciated that, because the adhesive on the third panel straddles the longitudinal and transversely extending perforation lines, the removal of the side and top margins of the mailer enables the adhesive inset from those longitudinally registering perforation lines and the adhesive inset from the second and third laterally registering perforation lines to maintain the three sides of the second and third panels secured one to the other to define the return envelope and maintain it intact.

After the side margins and top of the mailer are removed, it will be appreciated that the first panel is free, except for its attachment via the first foldline to the second panel. Preferably, that foldline is perforated, enabling the first panel to be removed entirely from the return envelope formed by the second and third panels. Once removed, the remaining strip of the first panel bearing the vegetable-based ink coating can be removed leaving the panel portion or ticket. The ticket normally comprises a stub or receipt and a remittance slip. After the stub and remittance slip are separated, the remittance slip can be disposed in the return envelope without folding with the return address on the opposite face of the remittance slip appearing through the window of the second panel. The flap on the end of the third panel may then be wetted to activate the rewettable adhesive and folded over onto the outside face of the second panel to seal the return envelope with the remittance slip inside. Consequently, it will be appreciated that both the heat seal and rewettable adhesive are applied to one face of the sheet and substantially all of the printing, except for the return address on the remittance slip, is likewise applied to that same face.

In another form of the present invention, the flap for the return envelope is formed within the confines of the third panel rather than constituting an extension of the third panel at its distal end. Also, instead of coating a portion of the first panel with a lateral strip of vegetable-based ink, a lateral strip of the second portion adjacent the first foldline is coated with the ink such that, upon folding the second and third panels about the second foldline, the rewettable adhesive of the flap of the third panel lies in opposition to the vegetable-based ink coating on the second panel. This embodiment requires an additional tearing of the coated strip along another perforation line in the second panel such that the flap of the third panel can be folded about a third foldline for adhesive securement of the opposite face of the second panel.

Accordingly, in accordance with a preferred embodiment of the present invention, there is provided a mailer with integral return envelope comprising an elongated sheet having first, second and third panels longitudinally spaced one from the other along the sheet and connected one to the other along first and second laterally extending, longitudinally spaced, foldlines, respectively. On one face of the sheet, adhesive is applied to the lateral margins of the first panel, the lateral margins of one of the second and third panels, the distal end margin of the first panel, and an end margin of the one of the second and third panels immediately adjacent the second foldline. Straight lines of perforations extend longitudinally along the entire length of the sheet along opposite sides thereof. The respective lateral margins of adhesive on the first panel face are disposed laterally outwardly of the longitudinally extending lines of perforations in the first panel and the respective lateral margins of adhesive on the second or third panel faces straddling the longitudinally extending lines of perforations in the third panel. First, second and third straight lines of perforations extend laterally respectively in the first, second and third panels, the first perforation line being inset from the distal end margin of adhesive in the first panel, the second perforation line extending in the second panel adjacent to and spaced longitudinally from the second foldline, the third perforation line in the third panel being spaced longitudinally from the second foldline substantially the same distance that the second perforation line in the second panel is spaced from the second foldline, the end margin of adhesive on the one of the second and third panels straddling the laterally extending line of perforations in such panel. The second and third panels are relatively foldable about the second foldline to register the second and third panel faces in opposition one to the other and to adhesively secure the registering margins of the second and third panels one to the other. The first panel is foldable about the first foldline to register the first panel face and the opposite face of the third panel in opposition one to the other to adhesively secure the registering margins of the first panel to the opposite face of the third panel to form a mailer, such that the first, second and third lines of perforations lie in registration each with the other and the longitudinally extending lines of perforations lie in registration each with the other whereby the lateral margins and one end margin of the mailer may be removed by the original addressee to form a return envelope defined by the second and third panels. Means are carried by the first panel including at least one line of perforations defining a portion of the first panel removable from the first panel and receivable in the return envelope without folding said first panel portion, the second panel having a window formed therein such that address information on the face of the third panel may be displayed thrugh the window when the panels are folded and adhesively secured to form the mailer.

Accordingly, it is a primary object of the present invention to provide a novel and improved C-fold mailer with integral return envelope and remittance slip, which is readily and easily manufactured in a single, continuous business form web, relatively easily opened and disassembled to form the return envelope and remittance slip, and readily reused for return mailing with the remittance slip disposed in the return envelope and to a method of making the C-fold mailer.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
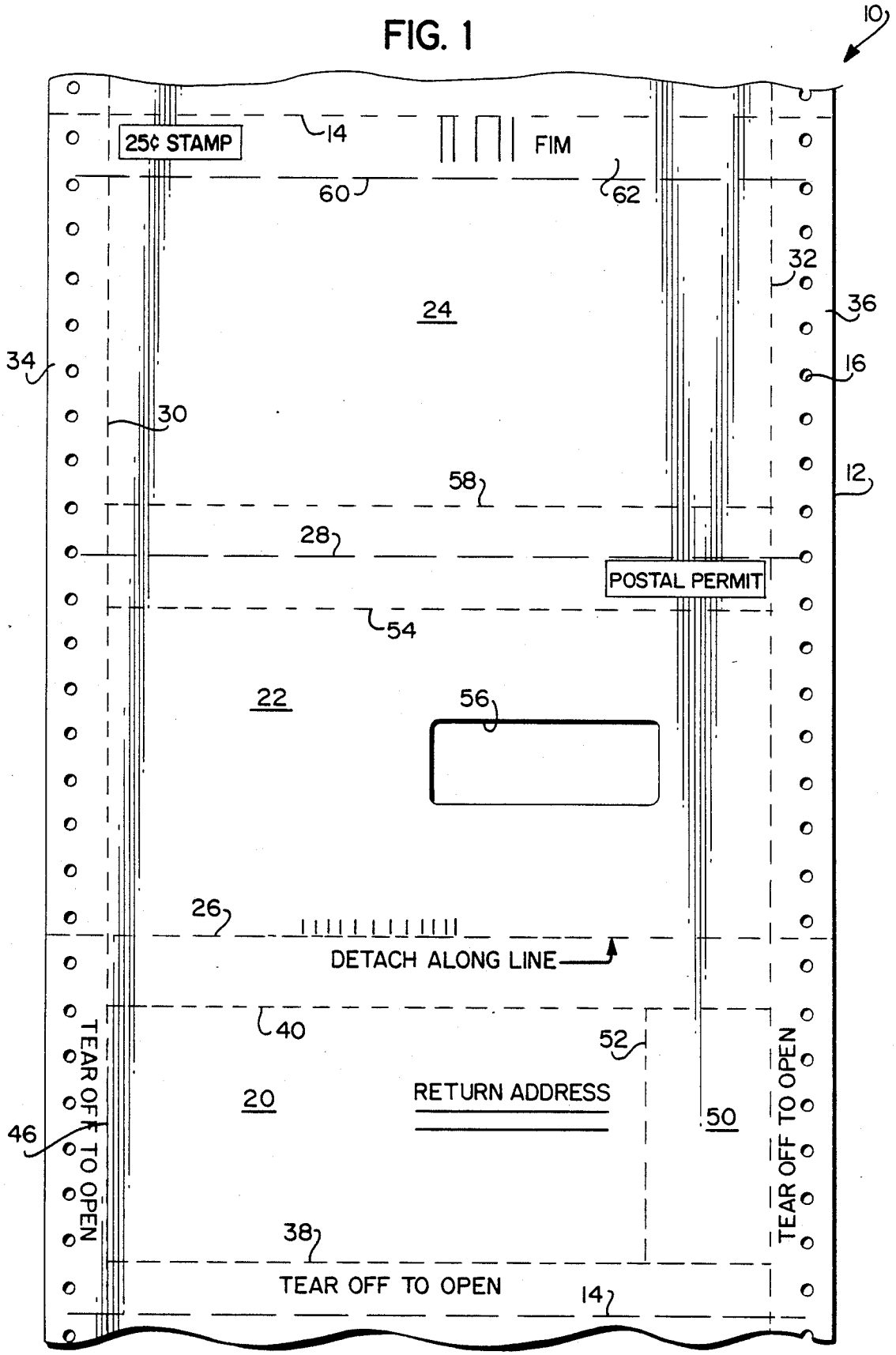
FIG. 1 is a fragmentary plan view of a continuous business form for forming mailers constructed in accordance with the present invention.

Referring now to FIG. 1, there is illustrated a continuous business form web, generally designated 10, comprised of a single ply of paper separable into elongated sheets for forming discrete mailers 12, respectively. The sheets in the continuous form web 10 are joined one to the other at opposite ends by laterally extending lines of perforations 14. It will be appreciated that the continuous business form web 10 has a plurality of tractor openings 16 spaced longitudinally one from the other along opposite sides of the form such that the continuous form can be handled by machines having correspondingly spaced tractor pins, such as high-speed printers, not shown. In this manner, the single continuous ply of paper may be disposed in various machines common in the printing industry for performing slitting, printing and adhesive applying operations on various portions of the form, as described hereinafter.

Figure 2:
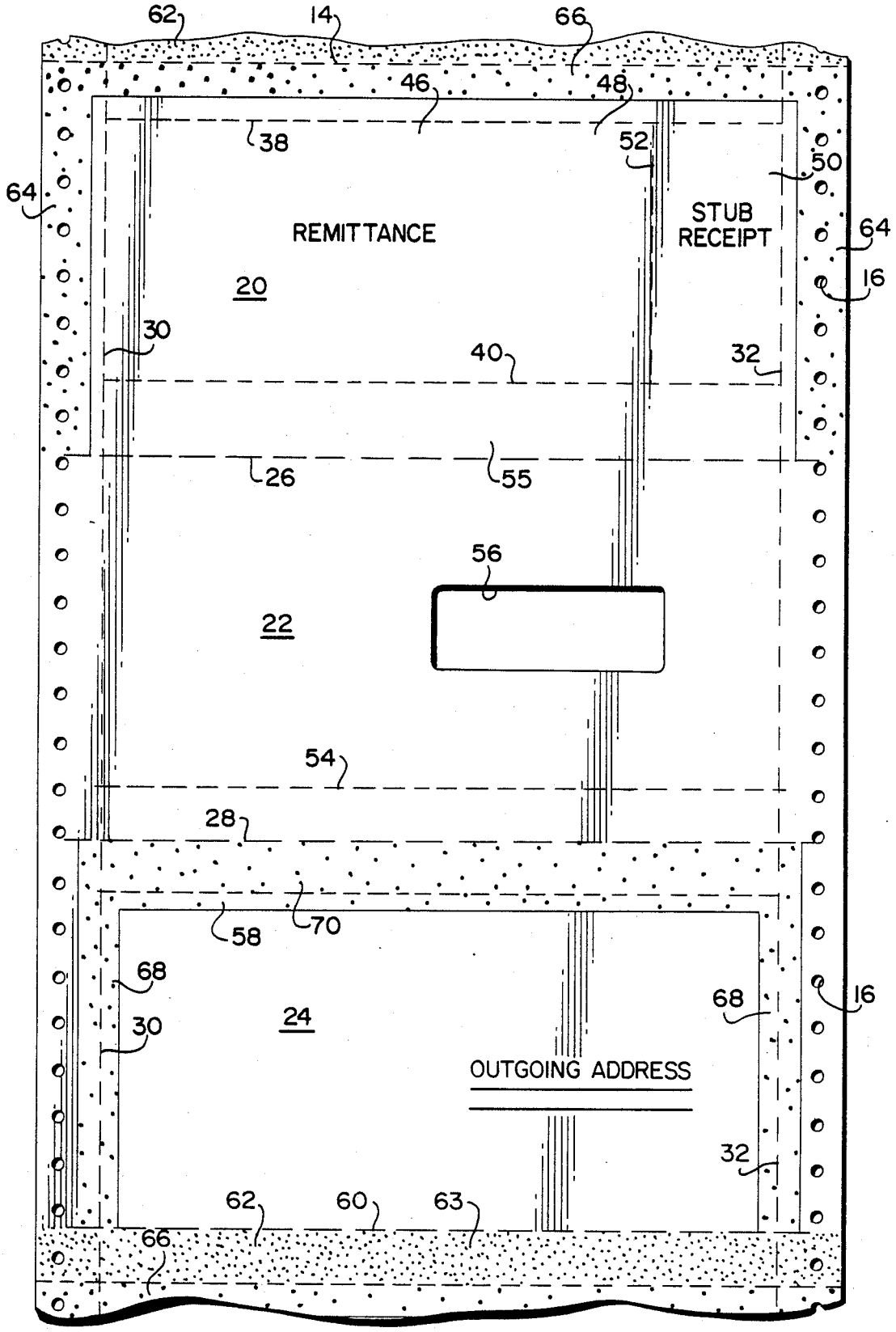
FIG. 2 is a view similar to FIG. 1 illustrating the reverse side of the form illustrated in FIG. 1.
Figure 3:
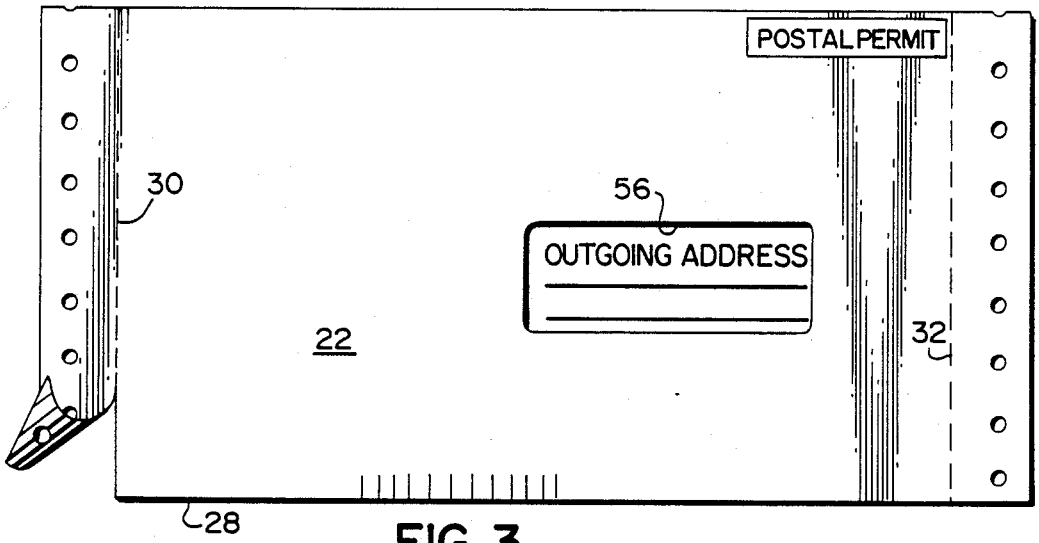
FIG. 3 is a front elevational view of the mailer illustrating the address side of the mailer.
Figure 4:
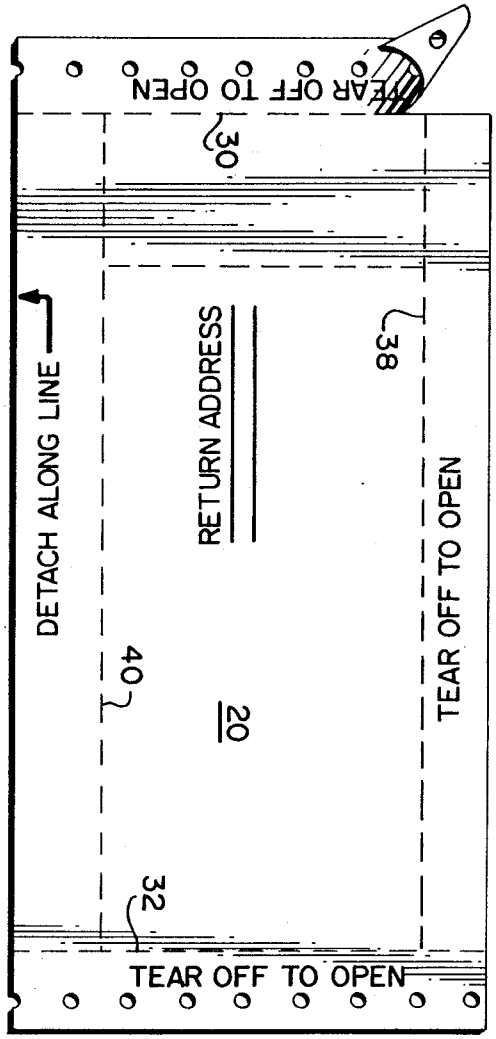
FIG. 4 is a view similar to FIG. 3 illustrating the reverse side of the mailer.
Figure 5:
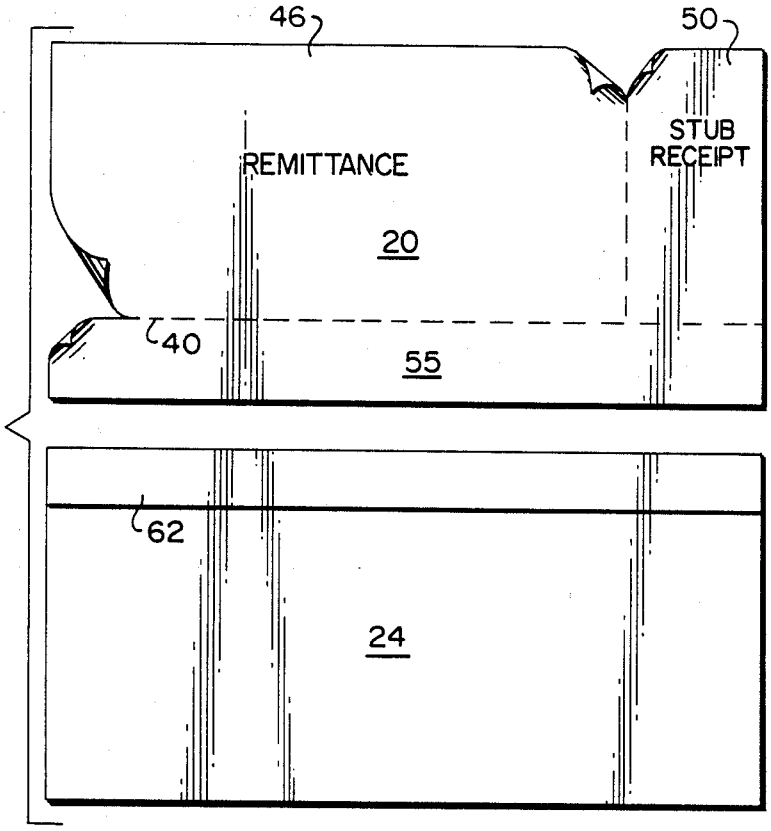
FIG. 5 is a side elevational view of the mailer after opening with a first panel thereof defining a remittance slip and stub removed from the second and third panels forming the return envelope.
Figure 6:
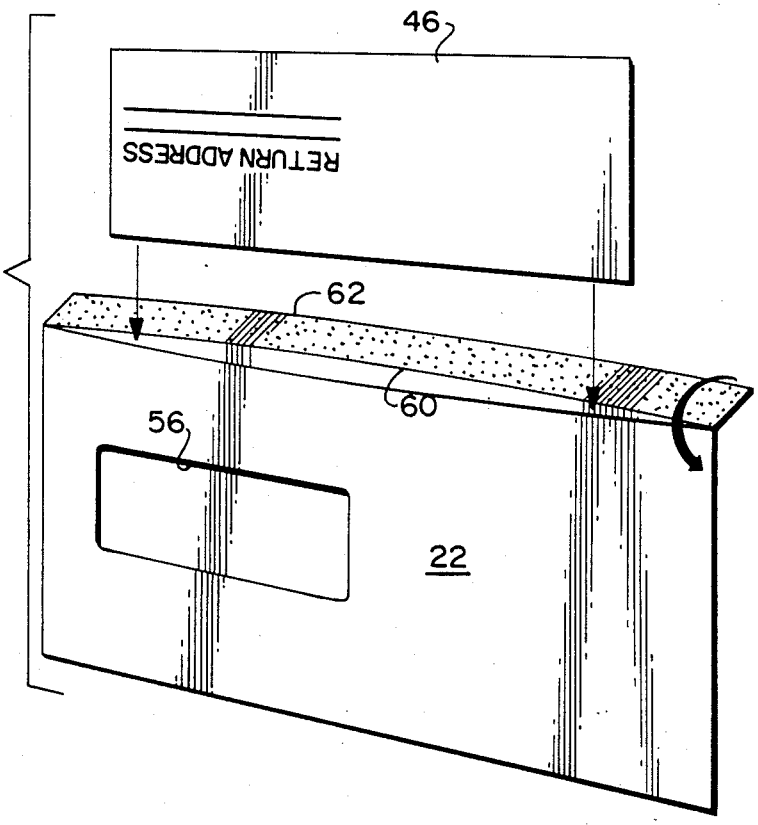
FIG. 6 is a perspective view of the reverse side of the return envelope illustrated in FIG. 5 with the remittance slip poised for placement within the return envelope.
Figure 8:
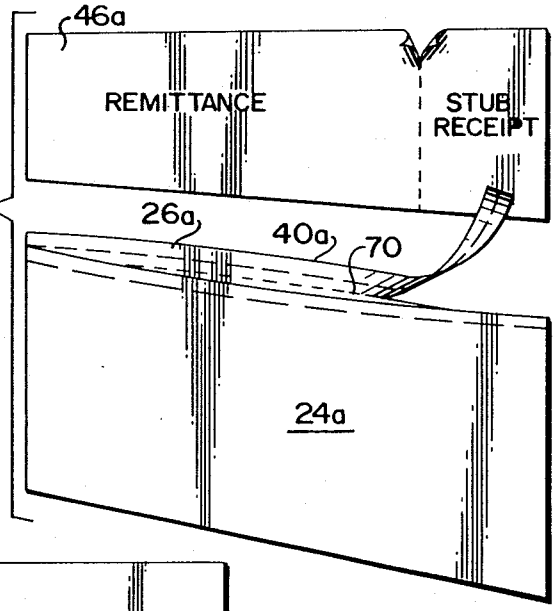
FIG. 8 is a perspective view of the return envelope and remittance slip and stub of the embodiment hereof illustrated in FIG. 7.
Figure 9:
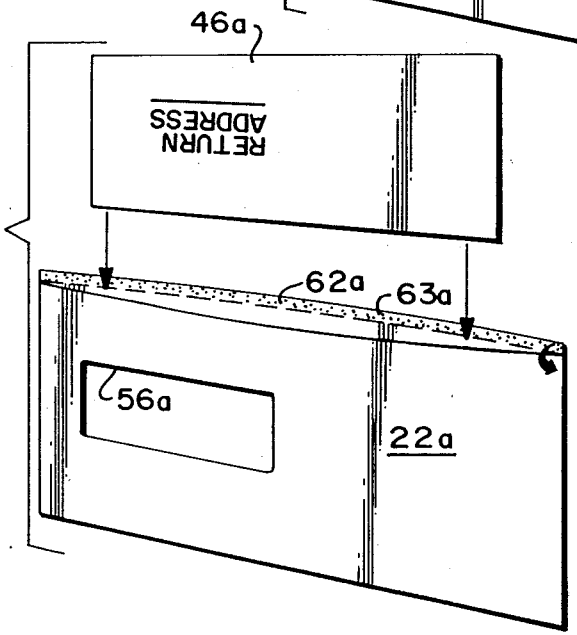
FIG. 9 is a view similar to FIG. 8 illustrating the insertion of the remittance slip into the return envelope.
Figure 10:
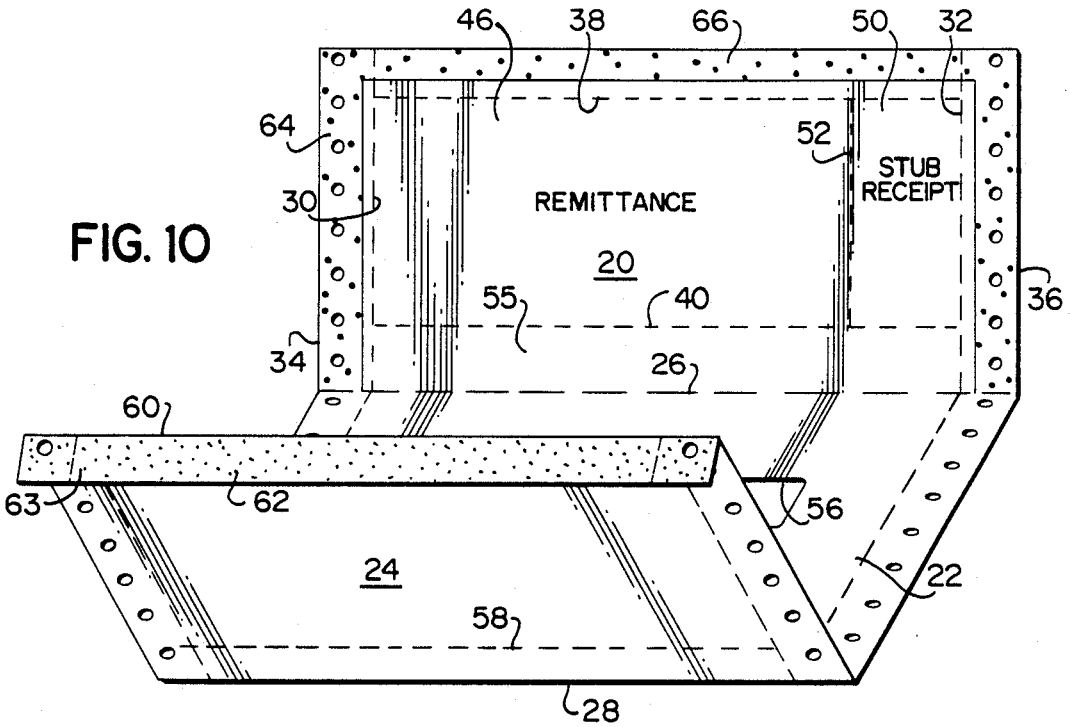
FIG. 10 is a perspective view illustrating the C-fold of the mailer of the first embodiment hereof.

As will be seen from a review of FIGS. 1, 2 and 10, each elongated sheet, when separated from the continuous form 10 along the transverse lines of perforations 14, may be formed into a mailer 12. Each mailer 12 is comprised of first, second and third panels 20, 22 and 24, respectively, longitudinally spaced one from the other along the sheet. First and second panels 20 and 22, respectively, are joined one to the other along a transversely extending foldline 26, while second and third panels 22 and 24 are similarly joined one to the other along a transversely extending foldline 28. The foldlines comprise weakened portions of the paper and may be formed by providing lines of perforations for purposes of either ultimately separating the panels one from the other or for weakening the paper to enable folding where ultimate separation is not required or desired. Thus, the term "foldline" as used herein means a weakened portion of the paper for purposes of folding the paper and does no necessarily include or exclude lines of perforations for purposes of separating one panel from the other.

From a review of FIGS. 1, 2 and 10, it will also be appreciated that the continuous business form web 10 includes straight lines of perforations 30 and 32 extending longitudinally along the respective opposite sides of the form the entire length thereof inset from the tractor openings 16. The marginal strips 34 and 36, defined by the lines of perforations 30 and 32, respectively, enable the continuous form web to proceed through the manufacturing process, including the slitting, printing and gluing operations, and form an integral part of the mailer, as will be appeciated from the ensuing description.

From an inspection of FIGS. 1 and 2, it will be seen that the first panel 20 also includes a transverse line of perforations 38 which extends transversely between the longitudinally extending lines of perforations 30 and 32. Perforation line 38 is spaced longitudinally a predetermined distance from separation line 14 of the first panel 20. Additionally, and with reference to FIGS. 1 and 2, the first panel 20 includes a transverse line of perforations 40 extending between the longitudinally extending perforation lines 30 and 32 and spaced from foldline 26.

Transverse perforation lines 38 and 40, together with the longitudinally extending perforation lines 30 and 32, define the margins of a ticket 46. The ticket 46, as best illustrated in FIG. 2, is comprised of a major portion 48 which, for example, may be a remittance slip and a minor portion 50, which may, for example, form a stub. The remittance and stub portions of the ticket 46 are separable one from the other by a perforation line 52, which extends longitudinally between the transverse perforation lines 38 and 40 adjacent one side of ticket 46. Panel 22 likewise has a transversely extending line of perforations 54 extending between the longitudinally extending perforation lines 30 and 32 and spaced longitudinally from the foldline 28 a distance equal to the distance perforation line 38 is spaced from the separation line 14 of panel 20. Panel 22 also includes a die-cut window 56 opening through mailer 12.

Third panel 24 includes a transverse perforation line 58 extending between the longitudinal perforation lines 30 and 32 and spaced longitudinally from transverse foldline 28 a distance equal to the distance the perforation line 54 extends longitudinally from foldline 26 and perforation line 38 extends longitudinally from foldline 26 for reasons which will become apparent from the ensuing description. Also referring to FIGS. 1, 2 and 10, a foldline 60, for example, comprised of transversely extending perforations, is spaced longitudinally from the separation line of perforations 14 for panel 24 to define a flap 62 for purposes which will become clear. Rewettable glue or adhesive is provided along the inside face of flap 62 at 63.

The third panel 24 has, on the face thereof illustrated in FIG. 2, pre-printed information which may be variable and computer-generated, for example, an outgoing address, which, when the sheet 12 is folded to form the mailer, will appear through the window 56. Additionally, the remittance portion 48 of the ticket 46 includes a return address as illustrated in FIG. 1 which, when inserted in the return envelope, will similarly appear through the address window 52. For reasons described hereinafter, a transversely extending strip of vegetable-based ink 55 is provided transversely along the inner margin of first panel 20 between perforation line 40 and foldline 26. It will be appreciated that, in this embodiment, panels 20 and 22 extend longitudinally a like distance, whereas panel 24 extends longitudinally from foldline 28 to perforation line 60 a like longitudinal distance but additionally carries a further longitudinal portion constituting flap 62.

Referring now to FIGS. 2 and 10, the reverse side of the mailer from the side illustrated in FIG. 1 is provided with strips of adhesive at predetermined locations along the panels such that the mailer 12 can be assembled and subsequently knocked down to form a return envelope. Turning now particularly to FIG. 2, the opposite sides of the first panel 20 has a permanent type heat sealable adhesive applied to the lateral margins at 64 and transversely along the distal end margin at 66. The adhesive strips 64 along the lateral margins straddle the tractor openings 16 and are spaced laterally outwardly of the longitudinally extending lines of perforation 30 and 32, respectively. The distal end adhesive strip 66 is also spaced outwardly of the transverse perforation line 38. Consequently, ticket 46, defined by the longitudinally extending perforation lines 30 and 32 and the transversely extending perforation lines 38 and 40, is wholly free of adhesive. As illustrated in FIG. 2, the second or intermediate panel 22 is also preferably wholly free of adhesive.

The third panel 24 similarly has a permanent type heat sealable adhesive applied to marginal portions. For example, the lateral margins of the third panel are provided with adhesive strips 68 inset from tractor openings 16 and which strips 68 straddle the longitudinally extending lines of perforation 30 and 32, respectively, in the third panel. A transversely extending strip of permanent type heat sealable adhesive 70 is also applied to third panel 24 and has a width which extends from the foldline 28 longitudinally beyond the line of perforations 58 such that the perforation line 58 is straddled by adhesive margin 70. It will be appreciated from FIG. 2 that the longitudinally extending adhesive strips 68 terminate at the foldline 60 which defines flap 62. As indicated previously, flap 62 is provided with a rewettable adhesive strip 63 which extends transversely at least the length of flap 62 between perforation lines 30 and 32. It will be appreciated from the following description of the assemblage of the mailer that one or the other or both of the marginal adhesive strips 68 and 70 could be located along the second panel rather than along the third panel in corresponding positions when the panels are folded to form the return envelope as described hereinafter.

To assemble the mailer, reference is made to FIG. 10. In FIG. 10, the panels 20, 22 and 24 are folded into a generally C-shaped configuration about foldlines 26 and 28. More particularly, flap 62 is folded about foldline 60 and panels 22 and 24 are folded in the opposite direction about foldline 28 such that the adhesive margins 68 and 70 on panel 24 register with corresponding portions of the inner face of the second panel 22. Thus, the outgoing address information on the inside face of panel 24 appears in the window 56. After the second and third panels 22 and 24 have been folded together, the first panel 20 is folded about foldline 26 to overlie flap 62, particularly on the rewettable adhesive side 63 of flap 62, the first panel 20 extending along the outside face of panel 24. Heat is applied to the mailer along the margins such that the heat-sealable adhesive is activated and secures the panels one to the other to form the mailer.

When the mailer is completely folded, it will be appreciated that the longitudinal lines of perforation 30 and 32 in each of the panels lie in registry each with the other. Also, when the panels are completely folded as indicated, the transverse perforation lines 38, 54 and 58 register one with the other. Further, the wettable adhesive 63 along flap 62 registers with the vegetable-based ink 55 formed on the first panel 20 such that the rewettable adhesive 63 is prevented from adhering to the first panel when the mailer is folded and heat is applied.

As a result of the heat-sealing, it will be appreciated that the first panel 20 is secured to the outer face of the second panel 22 by the marginal adhesive strips 64 and 66 outwardly of the longitudinally registering perforation lines 30 and 32 and the transversely registering perforation lines 38, 54 and 58, respectively. It will also be appreciated that the marginal adhesive strips 68 and 70 secure the second and third panels one to the other in a manner such that strips 68 straddle the registering perforation lines 30 and 32 and strip 70 straddles the registering perforation lines 54 and 58. In this manner, when the recipient receives the mailer, the three plies of lateral marginal strips 34 and 36 registering one with the other may be removed from the mailer by tearing along the aligned perforation lines 30 and 32. The transverse marginal strips of the first, second and third panels may likewise be removed by tearing along the registered transversely extending perforation lines 38, 54 and 58. That is, by tearing along those latter perforation lines, the strip of the first panel 20 between perforation line 38 and the first panel separation line 14, the strip in second panel 22 between perforation line 54 and foldine 28, and the strip in the third panel 24 between perforation line 58 and foldline 28 may be simultaneously removed.

It will be appreciated that by removing these longitudinal and transverse strips, the second and third panels remain adhered one to the other along three of their four margins to define the return envelope. That is, the portions of the adhesive on the third panel 24 inset from the perforation lines 30, 32 and 58 remain and secure the second and third panels one to the other. The opening for the return envelope is defined between registering foldlines 26 and 60. First panel 20, of course, remains secured to the return envelope at foldline 26.

Having removed the marginal and transverse strips, the recipient of the mailer may then remove first panel 20 by tearing along foldline 26. The ticket 46 is then separated from first panel 20 by tearing along perforation line 40. Stub 50 may then be removed from the resulting ticket 46 such that only the remittance slip 48 remains. The remittance slip is now of a size for disposition in the return envelope. Information on the remittance slip may then be completed by the recipient of the mailer as necessary and additional materials, for example a check, may be disposed in the return envelope with the remittance slip. The remittance slip is, of course, located such that the return address appears through window 56. The flap 62 is then wetted and folded about foldline 60 to seal the return envelope.

Figure 7:
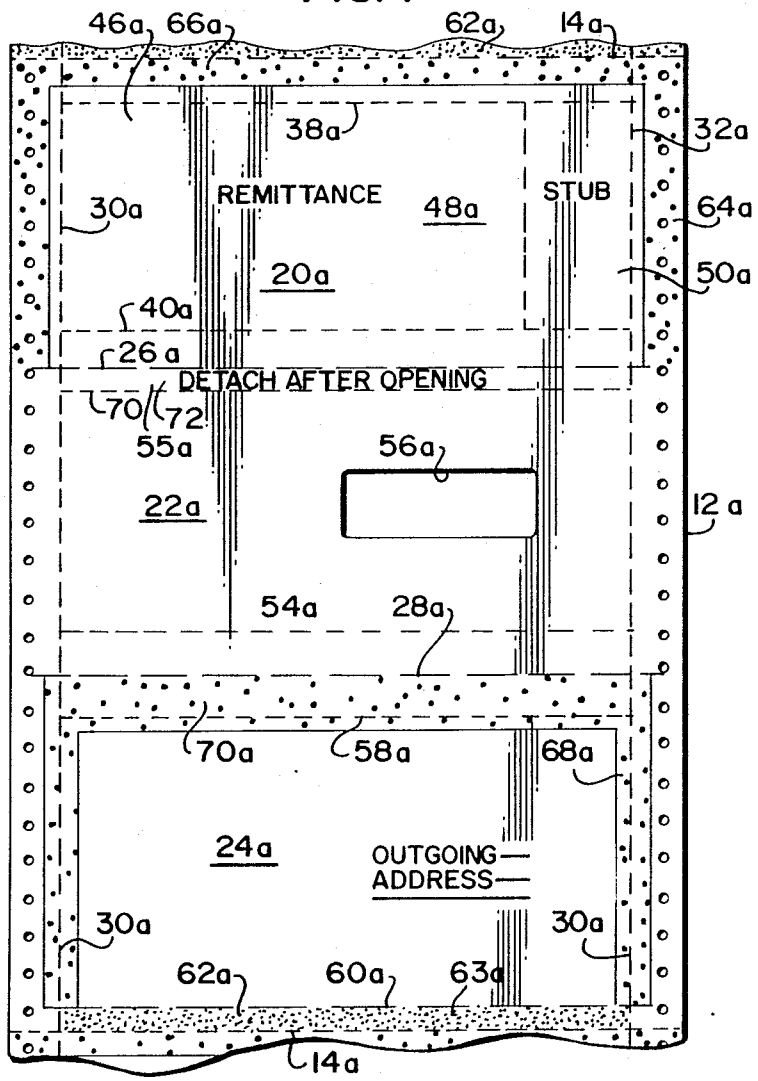
FIG. 7 is a view on a reduced scale of another embodiment of a mailer according to the present invention.
Figure 11:
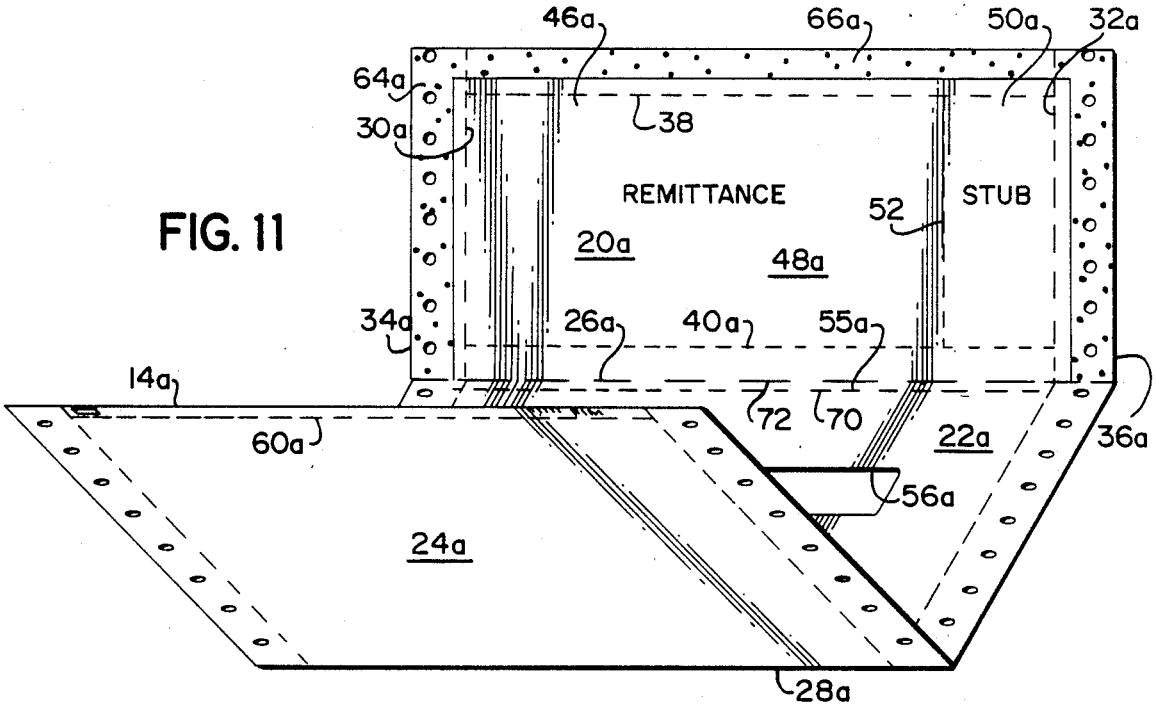
FIG. 11 is a perspective view similar to FIG. 10 illustrating the C-fold of the mailer of the second embodiment hereof.

Referring now to the embodiment hereof illustrated in FIGS. 7 and 11, wherein like reference numerals refer to like parts, followed by the suffix a, there is illustrated a mailer 12*a*, wherein the panels 20*a*, 22*a* and 24*a* are of like longitudinal extent. The panel 20*a* is identical to the panel 20 in the previous embodiment, except that the vegetable-based ink is not provided in the transverse strip between the perforation line 40*a* and foldline 26*a*. The adhesive strips and perforations are otherwise identical.

The intermediate or second panel 22*a* is similarly identical to the panel 22 illustrated in the previous embodiment, except that a perforation line 70 extends transversely between the longitudinally extending lines of perforation 30*a* and 32*a* adjacent the foldline 26*a* to provide a detachable strip 72. The vegetable-based ink 55*a* is applied to the detachable strip 72 on the adhesive side of the mailer. As described hereinafter, strip 72 is detachable from the mailer after the recipient receives the mailer and prior to using the return envelope.

The third panel 24*a* is identical to the third panel 24 of the previous embodiment, with the exception that its longitudinal extent is the same as the longitudinal extent of each of panels 20*a* and 22*a*. Rewettable glue 63*a* is applied to the flap 62*a* defined between the separation line 14*a* of the third panel and the perforation line 60*a*. As in the previous embodiment, the adhesive strips 68*a* along the lateral margins of the third panel and 70*a* along the margin thereof adjacent foldline 28*a* straddle the perforation lines 30*a*, 32*a* and 58*a*.

In this form, the second and third panels 22*a* and 24*a* are folded about foldline 28*a* such that the perforation lines 30*a* and 32*a* in the second and third panels 22*a* and 24*a*, respectively, register one with the other and such that perforation lines 54*a* and 58*a* register one with the other. The first panel 20*a* is then folded about foldline 26*a* to overlie the outer face of the third panel 24*a*, with its longitudinally extending perforation lines 30*a* and 32*a* in registry with perforation lines 30*a* and 32*a* of the second and third panels 22*a* and 24*a*, respectively. Likewise, the perforation line 38*a* registers with the perforation lines 54*a* and 58*a* of the second and third panels, respectively.

Thus, when the adhesive is activated by application of heat, the second and third panels are secured one to the other along three of their four margins, while the first panel is secured to the outer face of the third panel along the side margins and lower edge of the first panel. When the recipient receives the mailer, the marginal strips may be removed by tearing along the aligned perforation lines 30*a* and 32*a*. Also, removed by tearing along the registering perforation lines 38*a*, 54*a* and 58*a* are the adjoining strips of the second and third panels and the distal strip of the first panel. Consequently, the return envelope is comprised of the second and third panels 22*a* and 24*a*, joined by the adhesive inset from perforation lines 30*a*, 32*a* and 58*a* along the side and bottom margins, respectively, with the opening to the return envelope being provided between the free edge of flap 62*a* and foldline 26*a*. The recipient then removes the ticket 46*a* by tearing along the perforation line 40*a* or 70 or along foldline 26*a*. The remittance slip is then separated from the stub and the remittance slip, together with additional materials as necessary, i.e., is placed in the return envelope with its return address displayed through window 56*a*. If the strip 72 has not previously been removed, it may then be removed by tearing along perforation line 70, enabling the flap 62*a* with the rewettable glue to be folded about perforation line 60*a* onto the reverse side of the second panel to seal the return envelope.

It will be appreciated that the objects of the present invention are fully accomplished in the foregoing construction in that the glue, both the heat-sealable and rewettable glue, are applied to but one face of the continuous form. The vegetable-based ink is likewise applied to the same side of the form. Additionally, most of the printing may be applied to one side of the form. All of the printing may be performed on one side of the form if the return address on the remittance slip is disposed on its reverse side than as shown. Further, very little paper is wasted inasmuch as the marginal strips with the feed holes form part of the mailer forwarded to the recipient.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A mailer with integral return envelope comprising:

an elongated sheet having first, second and third panels longitudinally spaced one from the other along said sheet and connected one to the other along first and second laterally extending, longitudinally spaced, fold lines, respectively;

on one face only of said sheet, adhesive applied to lateral margins of said first panel, lateral margins of one of said second and third panels, a distal end margin of said first panel, and an end margin of one of said second and third panels immediately adjacent said second foldline;

straight lines of perforations extending longitudinally along the entire length of said sheet along opposite sides thereof, the adhesive on said lateral margins of said first panel being disposed laterally outwardly of the longitudinally extending lines of perforations in said first panel and the of adhesive on said lateral margins of one of said second and third panels straddling the longitudinally extending lines of perforations in the corresponding panel;

first, second and third straight lines of perforations extending laterally respectively in said first, second and third panels, said first perforation line being inset from the distal end margin of adhesive in said first panel, said second perforation line extending in said second panel adjacent to and spaced longitudinally from said second foldline a distance less than the distance between said second perforation line and said first foldline and defining an end margin adjacent said second foldline, said third perforation line in said third panel being spaced longitudinally from said second foldline substantially the same distance that said second perforation line in said second panel is spaced from said second foldline and defining another end margin adjacent said second foldline, the end margin of adhesive on said one of said second and third panels straddling one of said second and third laterally extending lines of perforations therein;

said second and third panels being relatively foldable about said second foldline to register said second and third panels in opposition one to the other and to adhesively secure and register (a) the lateral margins of said second and third panels one to the other and (b) the end margins adjacent said second foldline of said second and third panels one to the other, said first panel being foldable about said first foldline to register said first panel the said third panel in face to face opposition one to the other and to adhesively secure the lateral and distal end margins of said first panel to the lateral and end margins of said third panel to form a mailer and such that said first, second and third straight lines of perforations lie in registration each with the other and said longitudinally extending lines of perforations lie in registration each with the other whereby the lateral margins defined by the registering straight lines of perforations extending longitudinally along said first, second and third panels and one end margin of the mailer defined by the registering first, second and third straight lines of perforations may be removed along the respective registering lines of perforations to form a return envelope defined by said second and third panels;

means carried by said first panel including at least one line of perforations defining a portion of said first panel removable from said first panel and receivable in said return envelope without folding thereof; and said second panel having a window formed therein such that address information on the face of the third panel may be displayed through the window when the panels are folded and adhesively secured to form the mailer.

2. A mailer according to claim 1 wherein said return envelope has an opening defined between the distal end of said third panel and the margin of said second panel adjacent said second foldline when said second and third panels are secured one to the other.

3. A mailer according to claim 1 wherein said first panel portion has return address information thereon and is receivable in said return envelope to display the address information through said window.

4. A mailer according to claim 1 wherein said sheet has a laterally extending flap adjacent the distal end of said third panel, a third foldline between said flap and said third panel, said flap having a rewettable adhesive applied to the same side of said sheet as said marginal adhesives, said first panel being removable from said mailer along said first foldline, said flap being foldable about said third foldline in one direction to lie in opposition to said first panel when said first, second and third panels are folded to form the mailer and in the opposite direction, after the first panel has been removed, to close the return envelope with the rewettable adhesive on the flap securing the flap to the opposite face of said second panel.

5. A mailer according to claim 1 wherein said sheet forms part of a continuous business form web, the lateral margins of said sheet having a plurality of longitudinally-spaced tractor openings for receiving tractor pins.

6. A mailer according to claim 1 wherein said sheet has a laterally extending flap adjacent the distal end of said third panel and having a rewettable adhesive applied to the same side of said sheet as said marginal adhesives, said sheet having a third foldline between said flap and said third panel, said first panel being removable from said mailer along said first foldline, said flap lying in opposition to said second panel when said first, second and third panels are folded to form the mailer, said second panel having another laterally extending line of perforations adjacent to, but spaced from, said first foldline to define a strip removable from said second panel, said flap being foldable about said third foldline, after said first panel and said strip have been removed, to close the return envelope with the adhesive on the flap securing the flap to the opposite face of said second panel.

7. A mailer according to claim 6 wherein said detachable strip has a coating for substantially preventing adhesion of said flap to said second panel when said panels are secured one to the other to form the mailer.

8. A mailer according to claim 7 wherein said coating comprises a vegetable-based ink.

9. A mailer according to claim 1 wherein the longitudinal extent of each of said first and second panels is substantially identical one to the other.

10. A mailer according to claim 1 wherein said adhesive is applied solely to one face of said sheet and said second panel face is free of any adhesive.

11. A mailer according to claim 1 wherein said first panel is secured to said mailer only by said first foldline upon removal of the lateral margins and the one end margin of the mailer when forming the return envelope.

12. A mailer with integral return envelope comprising:

an elongated sheet having first, second and third panels longitudinally spaced one from the other along said sheet and connected one to the other along first and second laterally extending, longitudinally spaced, foldlines, respectively;

on one face only of said sheet, adhesive applied to lateral margins of said first panel, lateral margins of one of said second and third panels, a distal end margin of said first panel, and a transversely extending portion of one of said second and third panels immediately adjacent said second foldline;

straight lines of perforations extending longitudinally along the entire length of said sheet along opposite sides thereof, the of adhesive on said lateral margins of said first panel being disposed laterally outwardly of the longitudinally extending lines of perforations in said first panel and the of adhesive on said lateral margins of one of said second and third panel straddling the longitudinally extending lines of perforations extending along said one of said second and third panels;

first, second and third straight lines of perforations extending laterally respectively in said first, second and third panels, said first perforation line being inset from the distal end margin of adhesive in said first panel, said second perforation line extending in said second panel adjacent to and spaced longitudinally from said second foldline a distance less than the distance between said second perforation line and said first foldline and defining an end margin adjacent said second foldline, said third perforation line in said third panel being spaced longitudinally from said second foldline substantially the same distance that said second perforation line in said second panel is spaced from said second foldline and defining another end margin adjacent said second foldline, the transversely extending portion of adhesive on said one of said second and third panels being inset from said laterally extending line of perforations extending along said one of said second and third panels;

said second and third panels being relatively foldable about said second foldline to register said second and third panels in opposition one to the othe and to adhesively secure (a) the lateral margins of said second and third panels one to the other, (b) the end margins adjacent said second foldline of said second and third panels one to the other and (c) the transversely extending portion of said one of said second and third panels with the registering transversely extending portion of the other of said second and third panels, said first panel being foldable about said first foldline to adhere the adhesive margins of said first panel to said third panel to form a mailer and such that said first, second and third lines of perforations lie in registration each with the other and said longitudinally extending lines of perforations lie in registration each with the other whereby the lateral margins defined by the registering longitudinally extending straight lines of perforations in said first, second and third panels and one end margin of the mailer defined by the registering first, second and third lines of perforations may be removed along the respective registering lines of perforations to form a return envelope defined by said second and third panels; and means carried by said first panel including at least one line of perforations defining a portion of said first panel removable from said first panel and receivable in said return envelope without folding said first panel portion.

13. A mailer according to claim 12 wherein said second panel has a window formed therein such that address information on the face of the third panel may be displayed through the window when the panels are folded and adhesively secured to form the mailer.

14. A mailer according to claim 12 wherein said return envelope has an opening defined between the distal end of said third panel and the margin of said second panel adjacent said second foldline when said second and third panels are secured one to the other.

15. A mailer according to claim 12 wherein said first panel portion has return address information thereon and is receivable in said return envelope to display the address information through said window.

16. A mailer according to claim 12 wherein said sheet has a laterally extending flap adjacent the distal end of said third panel, a third foldline between said flap and said third panel, said flap having a rewettable adhesive applied to the same side of said sheet as said marginal adhesives, said first panel being removable from said mailer along said first foldline, said flap being foldable about said third foldline in one direction to lie in opposition to said first panel when said first, second and third panels are folded to form the mailer and in the opposite direction, after the first panel has been removed, to close the return envelope with the rewettable adhesive on the flap securing the flap to the opposite face of said second panel.

17. A mailer according to claim 12 wherein said sheet forms part of a continuous business form web, the lateral margins of said sheet having a plurality of longitudinally-spaced tractor openings for receiving tractor pins.

18. A mailer according to claim 12 wherein said sheet has a laterally extending flap adjacent the distal end of said third panel and having a rewettable adhesive applied to the same side of said sheet as said marginal adhesives, said sheet having a third foldline between said flap and said third panel, said first panel being removable from said mailer along said first foldline, said flap lying in opposition to said second panel when said first, second and third panels are folded to form the mailer, said second panel having another laterally extending line of perforations adjacent to, but spaced from, said first foldline to define a strip removable from said second panel, said flap being foldable about said third foldline, after said first panel and said strip have been removed, to close the return envelope with the adhesive on the flap securing the flap to the opposite face of said second panel.

19. A mailer according to claim 12 wherein said first panel is secured to said mailer only by said first foldline upon removal of the lateral margins and the one end margin of the mailer when forming the return envelope.

20. A mailer with integral return envelope comprising:

an elongated sheet having first, second and third panels longitudinally spaced one from the other along said sheet and connected one to the other along first and second laterally extending, longitudinally spaced, fold lines, respectively;

on one face only of said sheet, adhesive applied to lateral margins of said first panel, lateral margins of one of said second and third panels, a distal end margin of said first panel, and an end margin of one of said second and third panels immediately adjacent said second foldline;

straight lines of perforations extending longitudinally along the entire length of said sheet along opposite sides thereof, the adhesive on said lateral margins of said first panel being disposed laterally outwardly of the longitudinally extending lines of perforations in said first panel and the adhesive on said lateral margins of one of said second and third panel straddling the longitudinally extending lines of perforations in the corresponding panel;

first, second and third straight lines of perforations extending laterally respectively in said first, second and third panels, said first perforation line being inset from the distal end margin of adhesive in said first panel, said second perforation line extending in said second panel adjacent to and spaced longitudinally from said second foldline and defining an end margin adjacent said second foldline, said third perforation line in said third panel being spaced longitudinally from said second foldline substantially the same distance that said second perforation line in said second panel is spaced from said second foldline and defining another end margin adjacent said second foldline, the end margin of adhesive on said one of said second and third panels straddling one of said second and third laterally extending lines of perforations therein;

said second and third panels being relatively foldable about said second foldline to register said second and third panels in face to face opposition one to the other and to adhesively secure and register the lateral margins of said second and third panels one to the other, said first panel being foldable about said first foldline to register said first panel and said third panel in face to face opposition one to the other and to adhesively secure the lateral and end margins margins of said first panel to the lateral and end margins of said third panel to form a mailer and such that said first, second and third lines of perforations lie in registration each with the other and said longitudinally extending lines of perforations lie in registration each with the other whereby the lateral margins and one end margin of the mailer may be removed to form a return envelope defined by said second and third panels;

means carried by said first panel including at least one line of perforations defining a portion of said first panel removable from said first panel and receivable in said return envelope without folding thereof;

said second panel having a window formed therein such that address information on the face of the third panel may be displayed through the window when the panels are folded and adhesively secured to form the mailer;

said sheet having a laterally extending flap adjacent the distal end of said third panel, a third foldline between said flap and said third panel, said flap having a rewettable adhesive applied to the same side of said sheet as said marginal adhesives, said first panel being removable from said mailer along said first foldline, said flap being foldable about said third foldline in one direction to lie in opposition to said first panel when said first, second and third panels are folded to form the mailer and in the opposite direction, after the first panel has been removed, to close the return envelope with the rewettable adhesive on the flap securing the flap to the opposite face of said second panel; and a laterally extending margin of said first panel adjacent said first foldline and in opposition to the adhesive on said flap, when said panels are folded to form the mailer, having a coating for substantially preventing adhesion of said flap to said first panel.

21. A mailer according to claim 20 wherein said coating is comprised of a vegetable-based ink.

22. A mailer with integral return envelope comprising:

an elongated sheet having first, second and third panels longitudinally spaced one from the other along said sheet and connected one to the other along first and second laterally extending, longitudinally spaced, foldlines, respectively;

on one face only of said sheet, adhesive applied to lateral margins of said first panel, lateral margins of one of said second and third panels, a distal end margin of said first panel, and a transversely extending portion of one of said second and third panels immediately adjacent said second foldline;

straight lines of perforations extending longitudinally along the entire length of said sheet along opposite sides thereof, the adhesive on said lateral margins of said first panel face being disposed laterally outwardly of the longitudinally extending lines of perforations in said first panel and the adhesive on said lateral margins of one of said second and third panel faces straddling the longitudinally extending lines of perforations extending along said one of said second and third panels;

first, second and third straight lines of perforations extending laterally respectively in said first, second and third panels, said first perforation line being inset from the distal end margin of adhesive in said first panel, said second perforation line extending in said second panel adjacent to and spaced longitudinally from said second foldline and defining an end margin adjacent said second foldline, said third perforation line in said third panel being spaced longitudinally from said second foldline substantially the same distance that said second perforation line in said second panel is spaced from said second foldline and defining another end margin adjacent said second foldline, the transversely extending portion of adhesive on said one of said second and third panels being inset from said laterally extending line of perforations extending along said one of said second and third panels;

said second and third panels being relatively foldable about said second foldline to register said second and third panels in opposition one to the other and to adhesively secure and register the margins of said second and third panels one to the other and the transversely extending portion of said one of said second and third panels with the transversely extending portion of the other of said second and third panels, said first panel being foldable about said first foldline to adhere the adhesive margins of said first panel to said third panel in face to face opposition to form a mailer and such that said first, second and third lines of perforations lie in registration each with the other and said longitudinally extending lines of perforations lie in registration each with the other whereby the lateral margins and one end margin of the mailer may be removed to form a return envelope defined by said second and third panels;

means carried by said first panel including at least one line of perforations defining a portion of said first panel removable from said first panel and receivable in said return envelope without folding said first panel portion; and a laterally extending margin of said first panel adjacent said first foldline and in opposition to the adhesive on said flap, when said panels are folded to form the mailer, having a coating for substantially preventing adhesion of said flap to said first panel.

23. A method of forming a mailer with an integral return envelope comprising the steps of:

providing an elongated sheet having first, second and third panels longitudinally spaced one from the other along said sheet and connected one to the other along first and second laterally extending, longitudinally spaced foldlines, respectively;

providing straight lines of perforations extending longitudinally along the entire length of said sheet along opposite sides thereof;

providing first, second and third transversely extending straight lines of perforations, respectively, in said first, second and third panels, said first perforation line being inset from the distal end of said first panel, said second perforation line extending in said second panel adjacent to and spaced longitudinally from said second foldline, said third perforation line in said third panel being spaced longitudinally from said second foldline substantially the same distance that said second perforation line in said second panel is spaced from said second foldline;

applying adhesive solely to one face of said sheet, particularly along the lateral margins of said first panel outwardly of the longitudinally extending lines of perforations in said first panel, the lateral margins of one of said second and third panels such that the adhesive margin straddles the longitudinally extending lines of perforations in said one of said second and third panels, the distal end margin of said first panel outwardly of the transversely extending line of perforations of said first panel and an end margin of one of said second and third panels immediately adjacent said second foldline such that the adhesive margin straddles the transversely extending line of perforations in said one of said second and third panels;

folding said second and third panels relative to one another about said second foldline to register said second and third panel faces in opposition one to the other and adhesively securing the registering margins of said second and third panels one to the other along said adhesive margin;

folding said first panel about said first foldline and adhesively securing the adhesive margins of said first panel to the opposite face of said third panel to form a mailer;

the steps of folding and adhesively securing being such that said first, second and third lines of perforations lie in registration each with the other and said longitudinally extending lines of perforations lie in registration each with the other whereby the lateral margins and one end margin of the mailer form a return envelope defined by said second and third panels; and forming a window in said second panel such that address information on the face of the third panel may be displayed through the window when the panels are folded and adhesively secured to form the mailer.

24. A method according to claim 23 including the step of forming an opening between the distal end of said third panel and the margin of said second panel adjacent said second foldline when said second and third panels are folded and secured one to the other.

25. A method according to claim 23 including the steps of forming a laterally extending flap adjacent the distal end of said third panel and foldable about a third foldline between said flap and said third panel and applying a rewettable adhesive to said flap and to the same side of said sheet as said marginal adhesives.

26. A method according to claim 23 including the steps of providing a laterally extending flap adjacent the distal end of said third panel such that said flap lies in opposition to said second panel when said first, second and third panels are folded to form the mailer, applying a rewettable adhesive to the same side of said sheet as said marginal adhesives and to said flap, forming a third foldline between said flap and said third panel.

27. A method according to claim 23 including the steps of providing another laterally extending line of perforations along said second panel adjacent to, but spaced from, said first foldline to define a strip removable from said second panel, and applying a coating to said detachable strip for substantially preventing adhesion of said flap to said second panel when said panels are secured one to the other to form the mailer.

28. A method of forming a mailer with an integral return envelope comprising the steps of:

providing an elongated sheet having first, second and third panels longitudinally spaced one from the other along said sheet and connected on to the other along first and second laterally extending, longitudinally spaced foldlines, respectively;

providing straight lines of perforations extending longitudinally along the entire length of said sheet along opposite sides thereof;

providing first, second and third transversely extending straight lines of perforations, respectively, in said first, second and third panels, said first perforation line being inset from a distal end margin of said first panel, said second perforation line extending in said second panel adjacent to and spaced longitudinally from said second foldline and defining an end margin adjacent said second foldline, said third perforation line in said third panel being spaced longitudinally from said second foldline substantially the same distance that said second perforation line in said second panel is spaced from said second foldline and defining another end margin adjacent said second foldline;

applying adhesive solely to one face of said sheet, particularly along lateral margins of said first panel outwardly of the longitudinally extending lines of perforations in said first panel, lateral margins of one of said second and third panels such that an adhesive margin straddles the longitudinally extending lines of perforations in said one of said second and third panels, the distal end margin of said first panel outwardly of the transversely extending line of perforations of said first panel and an end margin of one of said second and third panels immediately adjacent said second foldline such that the adhesive margin straddles the transversely extending line of perforations in said one of said second and third panels;

folding said second and third panels relative to one another about said second foldline to register said second and third panels in opposition one to the other and adhesively securing the margins of said second and third panels one to the other along said adhesive margin;

folding said first panel about said first foldline and adhesively securing the lateral margins of said first panel to said third panel in face-to-face opposition to form a mailer providing the third panel with another laterally extending, longitudinally spaced foldline to define a closure flap for a return envelope defined by said second and third panels;

applying adhesive to the flap on the face to which adhesive was applied to said sheet;

the steps of folding and adhesively securing being such that said first, second and third lines of perforations lie in registration each with the other and said longitudinally extending lines of perforations lie in registration each with the other whereby the lateral margins and one end margin of the mailer form a return envelope defined by said second and third panels;

forming a window in said second panel such that address information on the face of the third panel may be displayed through the window when the panels are folded and adhesively secured to form the mailer; and applying a coating along a laterally extending margin of said first panel adjacent said first foldline and in opposition to the adhesive on said flap, when said panels are folded to form the mailer, for substantially preventing adhesion of said flap to said first panel.

* * * * *